US010064488B2

(12) United States Patent
Kunsch et al.

(10) Patent No.: US 10,064,488 B2
(45) Date of Patent: Sep. 4, 2018

(54) SIMPLE F-SHAPED SHELF AND TOOL HANGING BRACKET

(71) Applicants: Timothy J Kunsch, Middleton, WI (US); Gregory W. Kunsch, Virginia Beach, VA (US)

(72) Inventors: Timothy J Kunsch, Middleton, WI (US); Gregory W. Kunsch, Virginia Beach, VA (US)

( * ) Notice: Subject to any disclaimer, the term of this patent is extended or adjusted under 35 U.S.C. 154(b) by 0 days.

(21) Appl. No.: 15/658,360

(22) Filed: Jul. 24, 2017

(65) Prior Publication Data

US 2018/0035801 A1 Feb. 8, 2018

Related U.S. Application Data

(60) Provisional application No. 62/370,864, filed on Aug. 4, 2016.

(51) Int. Cl.
*A47B 96/06* (2006.01)
*A47B 96/07* (2006.01)

(52) U.S. Cl.
CPC ..... *A47B 96/061* (2013.01); *A47B 96/07* (2013.01); *A47B 96/06* (2013.01); *A47B 96/063* (2013.01)

(58) Field of Classification Search
USPC ..... 211/90.01, 119.003, 134, 135; 248/247, 248/248, 250
See application file for complete search history.

(56) References Cited

U.S. PATENT DOCUMENTS

| | | | | |
|---|---|---|---|---|
| 2,754,974 | A | 7/1956 | Larson | |
| 3,223,246 | A | 12/1965 | Daitch | |
| 3,381,636 | A | 5/1968 | Saiberlich | |
| 3,648,419 | A | 3/1972 | Marks | |
| 3,747,898 | A | 7/1973 | Warren | |
| 4,059,248 | A | 11/1977 | Kuntz | |
| 4,313,587 | A | 2/1982 | Loeschen | |
| 4,685,575 | A | 8/1987 | Kulbersh | |
| 4,809,941 | A | 3/1989 | Sheridan | |
| 4,934,642 | A * | 6/1990 | Baron | A47B 96/065 108/108 |
| 5,020,758 | A | 6/1991 | Rawlyk | |
| 5,388,709 | A | 2/1995 | Adams | |
| 5,680,940 | A | 10/1997 | D'Angelo | |
| 6,119,878 | A | 9/2000 | Zen | |
| 6,145,677 | A * | 11/2000 | Corniel | A47G 25/0692 211/105.1 |
| 6,345,795 | B1 | 2/2002 | Bartz, Jr. | |
| 7,240,803 | B2 | 7/2007 | Stitchick | |
| 7,497,343 | B2 | 3/2009 | Newman | |
| 8,408,404 | B2 | 4/2013 | Miller | |
| 8,434,629 | B2 | 5/2013 | Fernandez | |
| 9,187,922 | B1 * | 11/2015 | Phillips, Jr. | E04H 17/00 |
| 2005/0115861 | A1 | 6/2005 | Copeland | |

* cited by examiner

*Primary Examiner* — Alfred J Wujciak

(57) ABSTRACT

A simple bracket system for hanging tools, garden equipment, shelves, or other items. The system consists of two primary elements, a horizontal board mounted to the wall or structure, and F-shaped brackets which mount to the board in a unique fashion while maintaining a degree of horizontal adjustability. Additional elements such as spacers and strengtheners can be added depending on usage needs. The design allows for a low-cost storage system to be quickly installed for basic storage needs.

2 Claims, 3 Drawing Sheets

Perspective view of F-Bracket

Side view of F-Bracket
showing example embodiments

Embodiment 1

Embodiment 2

Embodiment 3

Embodiment 4

F-Bracket with Board Mounting Strengthener

SIMPLE F-SHAPED SHELF AND TOOL HANGING BRACKET

BACKGROUND

Field of the Invention

The present invention pertains to support brackets.

Description of the Related Art

There are many storage bracket and shelving system approaches on the market today. For simple, minimal load applications, such as a hanging system for garden equipment like brooms, rakes, hoes, or even lightweight shelving, these approaches are relatively complex and can quickly rise in cost as components are added.

A typical bracket or shelving system consists of vertical components attached to the wall to allow for vertical adjustment, having interlocking brackets to support shelving and hangers. Although these systems are ideal for closet shelving or more complex storage needs, for applications which don't require vertical adjustability, these vertical components are un-necessary and ultimately make the system more complex. These components drive up cost, and installation becomes more complex than many homeowners desire.

Other systems offer horizontal adjustability using a channel or rail style horizontal component. Although clever in design, fabrication of the channel or rail drives up the cost of the system.

It is the object of the present invention to provide a simple and low-cost system to allow for tool storage, basic shelving, and other hanging storage needs which a typical homeowner can easily install, adjust, and adapt for changing storage needs.

SUMMARY OF THE INVENTION

The attractiveness of the present invention is the simple approach. The invention uses a horizontal wood board such as a 2×4 which is typically available at a hardware or lumber store as the horizontal component of the system. The board is attached to the wall and unique F-shaped brackets hook over the board. The F-shaped brackets extend outward to support shelving or hanging storage needs. These brackets are easily installed, and are horizontally adjustable along the length of the board. The brackets can be manufactured in variety of styles to support different applications such as garden tools, hoses, equipment, and basic shelving needs.

DESCRIPTION OF THE SEVERAL VIEWS OF THE DRAWING

Drawings of the present invention are as follows.

Drawing (1)

Drawing (2)

Figure 1:
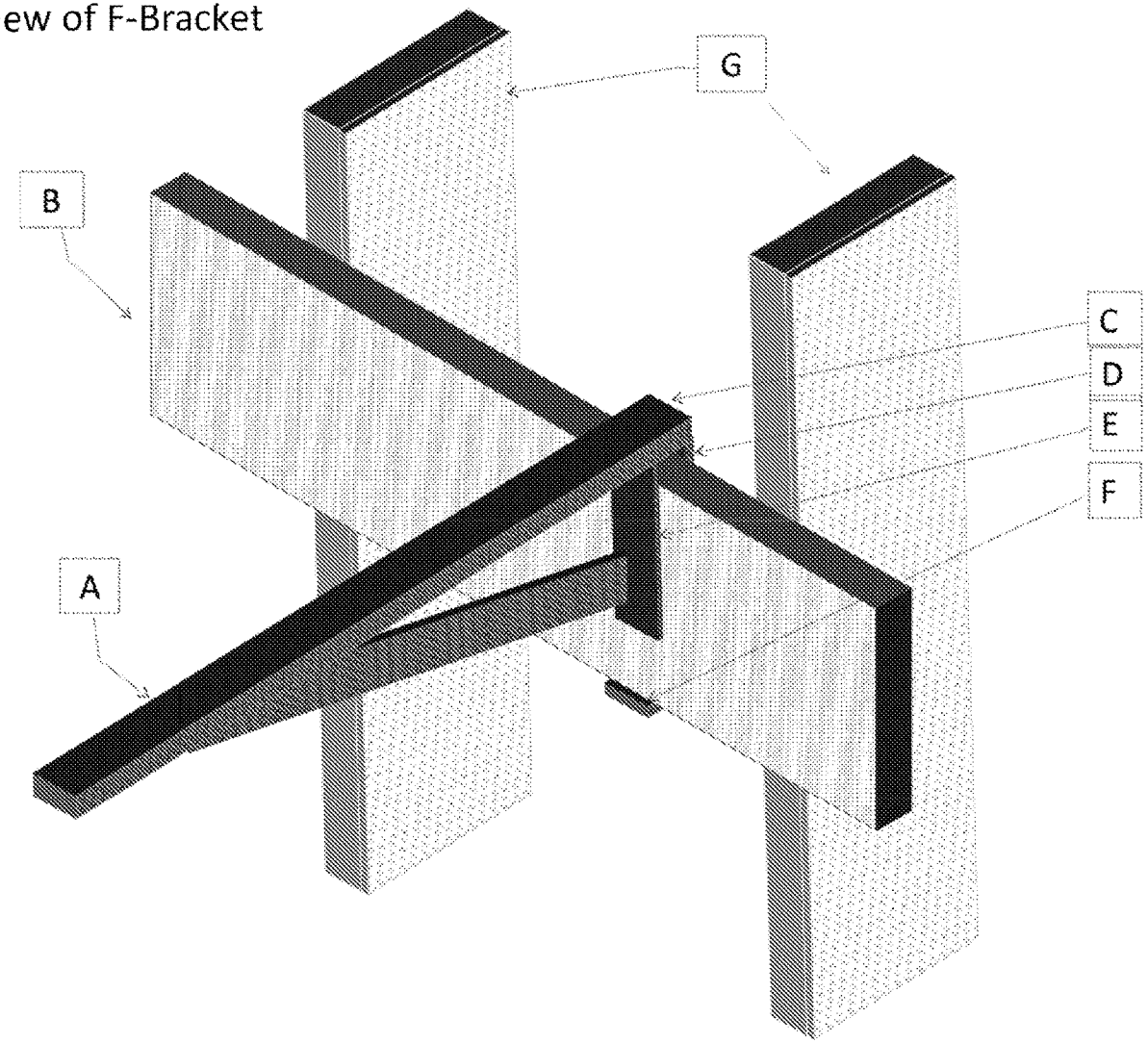
FIG. 1—Perspective view of F-Bracket
Figure 2:
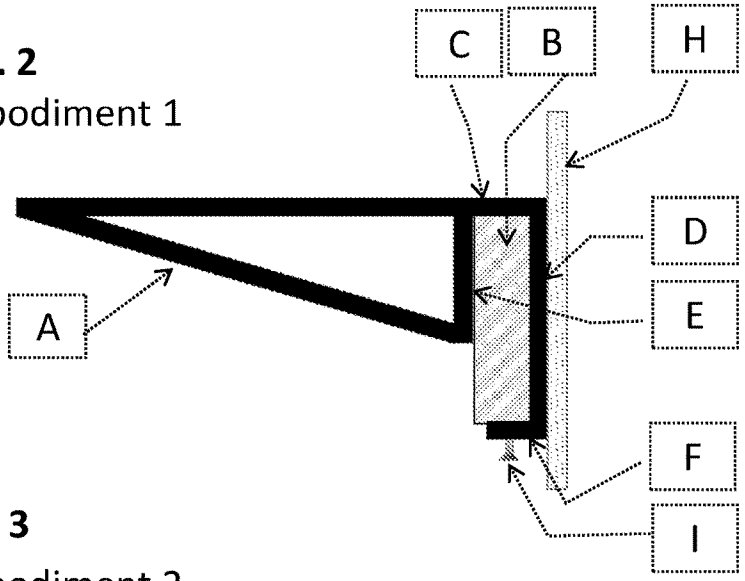
FIG. 2, FIG. 3, FIG. 4, FIG. 5—Side view of F-Bracket showing example embodiments Drawing (3)
Figure 3:
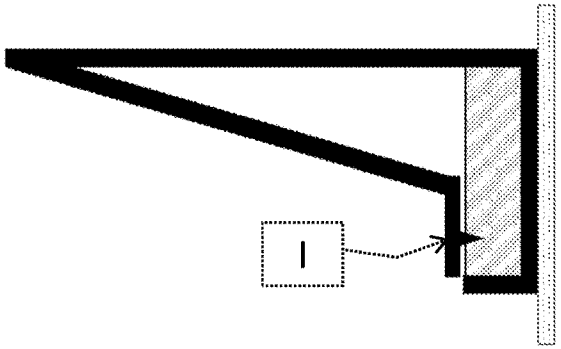
Figure 4:
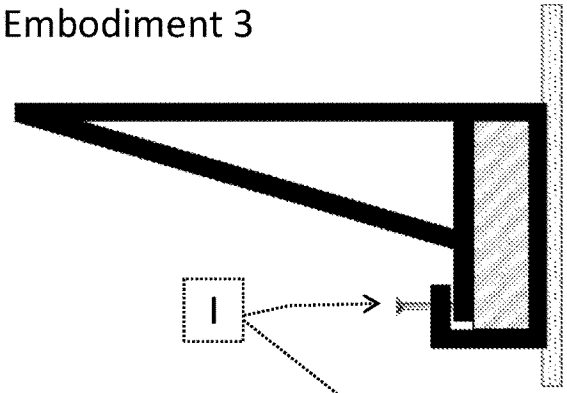
Figure 5:
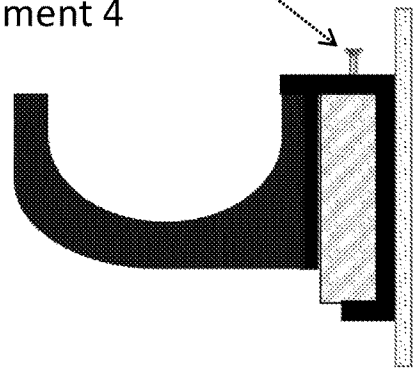
Figure 6:
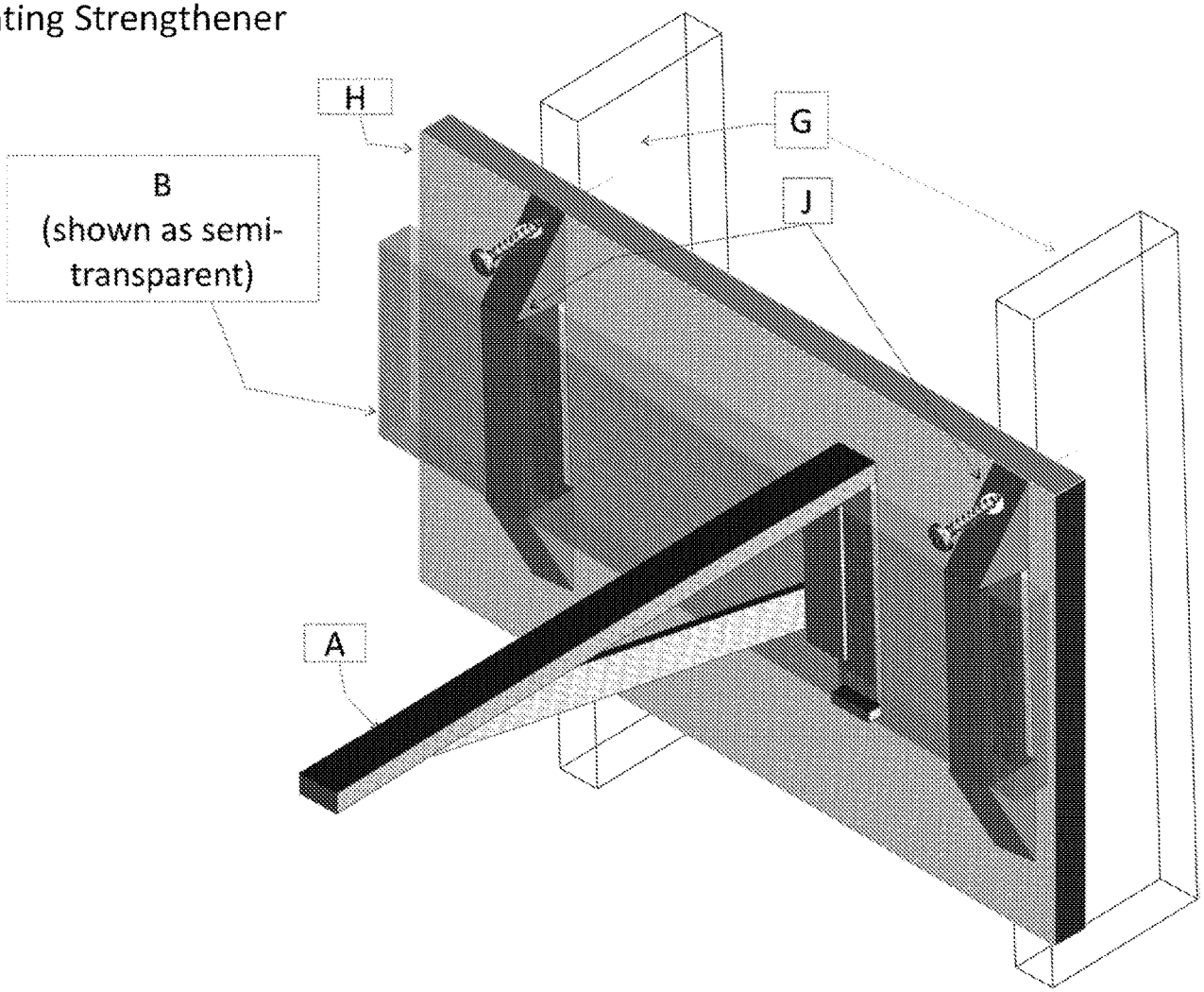
FIG. 6—Perspective view of F-Bracket with Board Mounting Strengthener Items depicted in the drawings.

A—F-Bracket
B—Board
C—F-Bracket top element
D—F-Bracket rear element
E—F-Bracket front element
F—F-Bracket bottom element
G—Vertical Stud H—Wall
I—Screw, Nail, or Barb
J—Mounting Strengthener Before any embodiments of the invention are explained in detail, it is to be understood that the invention is not limited in its application to the details of construction and the detailed arrangement of components set forth in the following description or illustrated in the following drawings. The invention is capable of other embodiments not listed herein, and of being practiced or of being carried out in various ways. Also, it is to be understood that the phraseology and terminology used herein is for the purpose of description and should not be regarded as limiting.

DETAILED DESCRIPTION OF THE INVENTION

The present invention provides an improved storage rack that can be easily mounted, adjusted, and taken down as desired. The storage rack consists of two primary components, a horizontally mounted board and a F-bracket. A third component which strengthens the mounting of the board to the wall is added to the system for higher loads.

Drawing 1 provides a perspective view of F-bracket. Item (E) is a vertical stud in a typical wall. Although depicted as a stud, this could be any type of vertical structure on which the bracket system is attached. This could be a self-standing structure, a brick wall, a concrete wall, or many other types of vertical structures. Item (B) is the board, which is wood based, and could be of varying size and thickness for example 2×4, 2×6, 2×8, or 1×4. The board may be those commonly found at a local lumber or hardware store. The board is attached to the stud, wall, or vertical structure with the use of a screw, lag bolt, or other bonding technique.

Item (A) is the F-bracket. Many embodiments of the bracket resemble a letter F or P turned 90 degrees clockwise. The "F-bracket" nomenclature is for descriptive purposes and is not intended as a technical description of the bracket. The bracket contains four primary elements. Item (C) is the element which crosses across the top of the board. Item (D) is the rear element of the bracket connecting with the rear of the board. Item (E) is the element of the bracket connecting with the front of the board. Item (F) is the element of the bracket connecting with the bottom of the board. These four elements allow the bracket to be mounted over the top of the board, providing a simple mounting method with ability for adjustment along the length of the board.

Drawing 3 shows the F-bracket with Board Mounting Strengtheners. Items (A,B,G) are the same as Drawings (1) and (2). Item (H) is the wall or vertical structure on which the bracket system is attached. Item (J) is the Board Mounting Strengthener. The Strengthener is longer than the board in a vertical plane. It connects with the front of the board, and distributes torque created by the bracket along a longer vertical plane on the wall. Although not needed for lighter loads, the strengthener may be necessary to support high bracket loads. One or many strengtheners may be used in these situations. The embodiment shown is one of many embodiments that could be used for this purpose.

Side views of the bracket showing several example embodiments are depicted on Drawing 2. Items (A,B,C,D, E,F,H) are the same as Drawings 1 and 3. Item (I) is Screw, Nail, or Barb which may be used in certain embodiments to provide additional securing of the bracket to the board. Embodiment 1 shows the F-bracket rear and front elements at different lengths with the bottom element partially along the bottom of the board; Embodiment 2 shows the F-bracket front element connecting to the top element at a different point, and the bottom element extending along the full length of the bottom of the board; Embodiment 3 shows the F-bracket rear and front elements at the same lengths with the bottom element wrapping around to the front; Embodiment 4 shows the F-bracket's four elements, with a shaped bracket continuing to extend from the front element.

The F-Bracket is not limited to a single arm or shape. Since the bracket is intended to support a variety of needs, many shapes are expected. For example, a flat horizontal could be used for shelving, an angled arm may be used for hanging tools, a dual arm may be used for rakes, hoes, brooms, or other garden or household equipment, and a wide inverted 'U' shaped could be used for garden hoses or electrical extension cords.

While this invention has been described with several embodiments, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A bracket system for supporting storage items, comprising:

a horizontal board mounts on a vertical wall;

a bracket joining over the top of the board, which has a rear element intersecting with the rear of the board, a front element intersecting with the front of the board, a top element extending outwardly from the board for supporting the storage items wherein the top element connecting the front and rear elements across the top of the board, a bottom element intersecting with the bottom of the board connecting with the rear element, wherein the front element, rear element and top element together create a F-shaped.

2. The bracket system of claim 1, with an additional mounting component connecting the board to the wall, which is longer than the height of the board in a vertical plane, connecting with the front face of the board and the wall.

* * * * *